US006035163A

United States Patent [19]

Zona et al.

[11] Patent Number: 6,035,163

[45] Date of Patent: Mar. 7, 2000

[54] VIBRATION ABSORBING BIAS CHARGE ROLL

[75] Inventors: Michael F. Zona, Holley; Alan M. Litman, Webster, both of N.Y.

[73] Assignee: Xerox Corporation, Stamford, Conn.

[21] Appl. No.: 09/196,584

[22] Filed: Nov. 20, 1998

[51] Int. Cl.[7] ..... G03G 15/02

[52] U.S. Cl. ..... 399/176; 361/225; 399/174

[58] Field of Search ..... 399/168, 176, 399/174; 361/221, 222, 225

[56] References Cited

U.S. PATENT DOCUMENTS

| | | | |
|---|---|---|---|
| 4,455,078 | 6/1984 | Mukai et al. | 399/175 |
| 4,967,231 | 10/1990 | Hosoya et al. | 399/176 |
| 5,062,385 | 11/1991 | Nishio et al. | 399/284 |
| 5,241,343 | 8/1993 | Nishio | 399/90 |
| 5,314,774 | 5/1994 | Camis | 430/47 |
| 5,324,885 | 6/1994 | Koga et al. | 399/279 |
| 5,384,626 | 1/1995 | Kugoh et al. | 399/176 |
| 5,402,213 | 3/1995 | Ikegawa et al. | 399/174 |
| 5,506,745 | 4/1996 | Litman | 361/225 |
| 5,510,879 | 4/1996 | Facci et al. | 399/168 |
| 5,534,344 | 7/1996 | Kisu et al. | 399/168 X |
| 5,543,899 | 8/1996 | Inami et al. | 399/176 |
| 5,576,805 | 11/1996 | Ishihara et al. | 399/176 |
| 5,602,626 | 2/1997 | Facci et al. | 399/135 |
| 5,625,858 | 4/1997 | Hirai et al. | 399/176 |
| 5,656,344 | 8/1997 | Sawa et al. | 428/36.5 |
| 5,666,606 | 9/1997 | Okano et al. | 399/174 |
| 5,765,077 | 6/1998 | Sakurai et al. | 399/176 |

FOREIGN PATENT DOCUMENTS

| | | |
|---|---|---|
| 1-211779 | 8/1989 | Japan . |
| 5-313452 | 11/1993 | Japan . |
| 7-219306 | 8/1995 | Japan . |

*Primary Examiner*—Susan S. Y. Lee
*Attorney, Agent, or Firm*—John S. Wagley; Andrew D. Ryan

[57] ABSTRACT

A charging roller for use in a machine in which an electrical bias is applied to a surface of a member is provided. The charging roller includes a shaft, a foam material surrounding at least a portion of the shaft, and a thermoplastic material. The thermoplastic material surrounds at least a portion of the foam material. The foam material is adapted to provide for greater compliance to prevent vibration of the roller against the surface.

28 Claims, 3 Drawing Sheets

VIBRATION ABSORBING BIAS CHARGE ROLL

The present invention relates to an electrophotographic printing machine. More specifically, the invention relates to charging a substrate.

The features of the present invention are useful in the printing arts and more particularly in electrophotographic printing. In the well-known process of electrophotographic printing, the charge retentive surface, typically known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder known as toner. Toner is held on the image areas by the electrostatic charge on the photoreceptor surface. Thus, a toner image is produced in conformity with a light image of the original being reproduced or printed. The toner image may then be transferred to a substrate or support member (e.g., paper), and the image affixed thereto to form a permanent record of the image to be reproduced or printed. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

To charge the surface of a photoreceptor, as well as to detach a copy sheet or to preclean the photoreceptor, a corotron or scorotron with a wired electrode and a shielded electrode is commonly used.

The use of a corotron or scorotron presents several problems including a requirement for an expensive high voltage source. The high voltage source requires a large space due to the structure of the corotron or scorotron and due to shielding of the high voltage source as well as the inherent size of the high voltage source itself. Further, the use of a scorotron or corotron results in the generation of a large amount of ozone. Ozone is believed by some to be a detrimental contributing factor to the long-term world environmental temperature changes and therefore equipment is required in many copy machines and printers to control the ozone there within.

Recently a contact type charging device has been used in place of the corotron or scorotron involved in the above problems. The contact type charging device includes a conductive member which is supplied a voltage from a power source with a D.C. voltage superimposed with a A.C voltage of no less than twice the level of the D.C voltage. The charging device contacts the image bearing member surface which is a member to be charged. The contact type charging device charges the image bearing member to a predetermined potential. Typically the contact type charger is in the form of a roller type charger such as that disclosed in U.S. Pat. No. 4,387,980, the relative portions thereof incorporated herein by reference.

In contact type charging systems, it is important that the charging member contacts the image bearing member uniformly along the length thereof. Contact charge type rollers therefore typically include a conformable material to maintain the contact with the photoconductive member. In typical printing applications, the A.C. and D.C voltages are applied to a roll type charger in contact with a photoconductive drum. Due to the oscillating voltage, an electric field is generated between the roll and the photoreceptor. This oscillating electric field causes the roll to vibrate against the surface of the drum surface, which generates an audible noise. This vibration not only generates objectionable noise to the customer, but may also create dissatisfying print quality due to non-uniform charging of the drum.

Attempts have been made to accommodate the vibration, which is inherent within these types of copy machines. For example, the photoconductive drum may be filled with a vibration absorbing material. Such vibration absorbing material added to the photoconductive drum may lead to difficulty in assembling the drum assembly to meet required specifications and adds to the cost of the drum assembly. An alternate approach to reducing the effects of vibration within the machine on the photoconductor/roller nip is to provide for modifications to the housings that support the rolls and drums to accept a dampening device which will dampen the vibration. These modifications to the housings in the form of dampening devices add to the cost and reduce the reliability of the copy machine.

Further, prior art charging devices, while providing adequate service, are expensive to manufacture. The prior art charging roll is made from several materials and manufactured in a series of manufacturing steps. Since each copier or printer may include not only a charging device but a similar biased transfer roll to transfer the developed image to the copy paper from the photoreceptor, as well as, a similar pre-cleaning charging device, the cost of the expensive charging devices can be substantial.

Photoconductive drums and belts are prone to defects. One of these defects effects the conductivity of the outer surface of the photoconductive drum or belt. Such defects can cause current leaks to occur to a conductive substrate.

Further, materials often chosen for proper electrical properties of a charging roll are very susceptible to environmental changes. Two particular environmental changes to which charge rolls are susceptible are temperature and humidity. While temperatures in most office environments may be within the range of 70° Fahrenheit to 80° Fahrenheit, variances within that temperature range can affect the operation of the charging rolls. It should be appreciated, however, that copying and printing machines might operate far outside of the typical 70° to 80° Fahrenheit temperature range and as such have greater affect on the performance of the copying or printing machines. Humidity within the office environment has an even greater affect than the temperature upon the operation of the charge roller. Humidity may range in an office environment from 10° to 80° relative humidity. The electrical properties of the materials used in a charging roll and in the machine in which the charging roll is used may very greatly within this wide range of relative humidity.

The following disclosures may be relevant to various aspects of the present invention:

U.S. Pat. No. 5,765,077

Patentee: Sakurai et al.

Issue Date: Jun. 9, 1998

U.S. Pat. No. 5,666,606

Patentee: Okano et al.

Issue Date: Sep. 9, 1997

U.S. Pat. No. 5,656,344

Patentee: Sawa et al.

Issue Date: Aug. 12, 1997

U.S. Pat. No. 5,625,858

Patentee: Hirai et al.

Issue Date: Apr. 29, 1997

U.S. Pat. No. 5,602,626

Patentee: Facci et al.

Issue Date: Feb. 11, 1997

U.S. Pat. No. 5,576,805

Patentee: Ishihara et al.

Issue Date: Nov. 19, 1996

U.S. Pat. No. 5,510,879

Patentee: Facci et al.

Issue Date: Apr. 23, 1996

U.S. Pat. No. 5,506,745

Patentee: Litman

Issue Date: Apr. 9, 1996

U.S. Pat. No. 5,324,885

Patentee: Koga et al.

Issue Date: Jun. 28, 1994

U.S. Pat. No. 5,314,774

Patentee: Camis

Issue Date: May 24,1994

U.S. Pat. No. 5,241,343

Patentee: Nishio

Issue Date: Aug. 31, 1993

U.S. Pat. No. 5,062,385

Patentee: Nishio, et al.

Issue Date: Nov. 5, 1991

U.S. Pat. No. 4,967,231

Patentee: Hosoya et al.

Issue Date: Oct. 30, 1990

U.S. Pat. No. 4,455,078

Patentee: Mukai et al.

Issue Date: Jun. 19, 1984

U.S. Pat. No. 5,765,077 discloses a charging member for charging a member to be charged includes a base member, a surface elastic member supported by the base member. The elastic member includes a foamed member and a coating layer covering the foamed member. A surface of the charging member has an Asker-C hardness of not more than 55 degrees and an international rubber hardness (IRHD) of not more than 80 degrees.

U.S. Pat. No. 5,666,606 discloses an image forming apparatus including a image bearing member having a photosensitive layer, a surface protection layer having fluorine resin material, and a charging member contactable to the image bearing member to electrically charge the image bearing member. The charging member is capable of being supplied with an oscillation voltage. A peak-to-peak voltage of the oscillating voltage applied across a gap between a surface of the charging member and the surface of the image bearing member is not less than twice a charge starting voltage of the image bearing member in the gap and not more than 1600 volt.

U.S. Pat. No. 5,656,344 discloses electroconductive polyurethane foam obtained by adding and dispersing, in the composition constituting polyurethane foam, a substance with electron conduction mechanism, and a substance with ionic conduction mechanism and mechanically agitating the resultant mixture in the presence of inert gas. The substance with ionic conduction mechanism is an antistatic agent selected from cationic surfactant, anionic surfactant, ampholytic surfactant, and non-ionic surfactant.

U.S. Pat. No. 5,625,858 discloses a contact charging member to be abutted against a charge-receiving member and supplied with a voltage for charging the charge-receiving member is provided. The charging member includes an electroconductive substrate, an elastic layer and a surface layer disposed in lamination. The surface layer comprises crosslinked polymer crosslinked by irradiation with an electron beam. The surface layer may preferably be in the form of a seamless tube formed of the crosslinked polymer. The surface layer crosslinked by electron beam irradiation is less liable to suffer from transfer of a crosslinking agent or a decomposition product thereof to the charge-receiving member. Accordingly, the charging member shows improved durability and stably uniform charging ability suitable for electrophotographic image formation under various environmental conditions.

U.S. Pat. No. 5,602,626 discloses an apparatus for applying an electrical charge to a charge retentive surface by transporting ions through an ionically conductive liquid and transferring the ions to the member to be charged across the liquid/charge retentive surface interface. The ionically conductive liquid is contacted with the charge retentive surface for depositing ions onto the charge retentive surface via a wetted donor blade supported within a conductive housing, wherein the housing is coupled to an electrical power supply for applying an electrical potential to the ionically conductive liquid. In one specific embodiment, the charging apparatus includes a support blade for urging the donor blade into contact with the charge retentive surface and a wiping blade for wiping any liquid from the surface of the charge retentive surface as may have been transferred to the surface at the donor blade/charge retentive surface interface.

U.S. Pat. No. 5,576,805 discloses a charging member contactable to a member to be charged to electrically charge it, the improvement residing in that a micro hardness of an end region, with respect to a longitudinal direction, of the charging member is larger than that in a central region of the charging member.

U.S. Pat. No. 5,510,879 discloses a process for charging layered imaging members by the transfer of ions thereto from an ionically conductive medium.

U.S. Pat. No. 5,506,745 discloses a device for charging a member. The device includes a roller contactable with the member to charge the member. The roller includes an elongated cylinder defining a central cavity in the elongated cylinder. The cylinder is flexible in a radial direction toward the central cavity. The device also includes an electrical biaser for electrically biasing the roller.

U.S. Pat. No. 5,324,885 discloses a developing device having a toner carrier for feeding a toner through pressure contact with a latent image carrier on which an electrostatic latent image pattern has been formed. The toner carrier comprises a foam member having a foam portion and a solid surface layer portion. The foam portion and the solid surface layer portion comprise an identical material and are continuous with each other substantially without the presence of any interface there between. The foam member has a density gradient in the direction of the thickness. The developing device of the present invention enables soft pressure contact development to be stably conducted, has advantageously low production and operation cost, and can form an image having a high resolution without a significant variation in the density.

U.S. Pat. No. 5,314,774 discloses an electrophotographic method and apparatus for developing and printing color images by the electrostatic projection of dry powder color toners onto a photoconductive member. A plurality of color toner projection units are spaced from the photoconductive member and are AC and DC biased to sequentially project each of the cyan, yellow, magenta, and black color planes onto the photoconductive member. The photoconductive member is directly driven against an intermediate transfer member which sequentially receives and stores each of the color planes to thereby form a composite color image, and each color plane is transferred from the photoconductive member before the next color plane is received thereon. The composite color image is then directly transferred to the print medium, whereby the use of the intermediate transfer member eliminates the problems of counter potentials at the surface of the photoconductive member and enables dot-on-dot (DOD) formatting to be utilized for achieving the maximum resolution and print quality of the printed image.

U.S. Pat. No. 5,241,343 discloses a conductive foam rubber roller is used as a charging roller, developing roller, toner-removing roller, or transfer roller in an image formation apparatus such as an electrophotographic recording apparatus, and comprises a tubular roller element made of a conductive foam rubber material and having a central bore defined by a solid skin layer having an electric resistivity considerably higher than that of a foam structure of the rubber element, and a conductive shaft on which the roller element is mounted and fixed. End sections of the skin layer are removed from the roller element such that the foam structure thereof is in direct contact with the shaft at end sections of the bore thereof. Alternatively, a conductive disc-like member having a central opening formed therein is inserted onto the shaft to be abutted against an end face of the roller element, whereby sufficient electric contact can be established between the roller element and the shaft.

U.S. Pat. No. 5,062,385 discloses a developing device using a one-component developer is composed of colored fine synthetic resin toner particles. The device includes a vessel for holding the developer, and a developing roller rotatably provided within the vessel in such a manner that a portion of the roller is exposed therefrom and resiliently pressed against a surface of an electrostatic latent image formation drum. The roller is formed of a conductive open-cell foam rubber material, and a surface thereof is thermally or chemically treated to prevent a penetration of the toner particles to an open-cell foam structure of the developing roller, whereby a softness of the developing roller can be maintained over a long period. The developing device further includes a blade or roller member provided within the vessel and resiliently engaged with the developing roller, for regulating a thickness of the developer layer formed around the developing roller.

U.S. Pat. No. 4,967,231 discloses a developing device effects desirable development when the amount of charging of toner, the amount of toner deposited on the surface of a developing roller per unit area, the speed of movement of the surface of the developing roller, the available length of the developing roller, and the magnitude of electric resistance between the surface of the developing roller and a power source for developing bias, are adjusted. The developing device produces a developed image desirable in quality and free from background fogging when the magnitude of a developing electric current. Further, when a charging device, an electrostatic latent image forming device, a transfer device, a cleaning device, a discharge device, a charging and cleaning device, an electrostatic latent image forming and cleaning device, a developing and cleaning device, or a discharging and cleaning device is provided with an elastic electroconductive roller composed of an elastic roller base and a flexible conductor layer, the device is allowed to decrease size and lower price, curb the decline of capacity due to protracted use, and preclude the occurrence of dispersion of characteristic, efficiency, or performance.

U.S. Pat. No. 4,455,078 discloses a charging device which includes a contact piled cloth which is formed of pliable material, has an electric resistance chosen to be $10^8$ ohm cm and contacts with a photosensitive layer of a photosensitive drum, an electrode which is electrically connected to the contact piled cloth and has an electric resistance lower than the predetermined electric resistance of the contact piled cloth, and D.C. power source and A.C. power source for supplying a voltage on the electrode to charge the photosensitive layer. The contact piled cloth is provided with a multitude of raised furs formed of artificial fibers with conductive particles dispersed therein.

As will be seen from an examination of the prior art, it is desirable to provide an electrophotographic copying system with a charging device that is simple, reliable, and inexpensive. The present invention is directed to overcoming at least some of the aforementioned problems.

SUMMARY OF THE INVENTION

In accordance with one aspect of the present invention, there is provided a charging roller for use in a machine in which an electrical bias is applied to a surface of a member. The charging roller includes a shaft, a semi-conductive foam material surrounding at least a portion of the shaft, and a semi-conductive thermoplastic material. The thermoplastic material surrounds at least a portion of the semi-conductive foam material. The foam material is adapted to provide for greater compliance to prevent vibration of the roller against the surface.

In accordance with yet another aspect of the present invention, there is provided an electrophotographic printing machine of the type including a process cartridge. The process cartridge includes a housing defining a chamber therein and a charging roller. The roller is mounted to the housing and is positioned at least partially therein. The charging roller includes a shaft and a semi-conductive foam material surrounding a least a portion of the shaft. The charging roller also includes a semi-conductive thermoplastic material surrounding at least a portion of the foam material. The foam material is adapted to provide for greater compliance to prevent vibration of the roller against the surface.

In accordance with still another aspect of the present invention, there is provided a charging roller for use in a machine in which an electrical bias is applied to a surface of a member. The charging roller includes a steel shaft and a semi-conductive conductive cellular foam material surrounding at least a portion of the shaft. The foam material has a hardness of approximately 40 AskerC and a resistance of approximately 100 to 1000 ohms. The charging roller may also include an adhesive applied to at least a portion of the periphery of the foam material and a thermoplastic seamless sleeve. The sleeve surrounds at least a portion of the adhesive. The foam material is adapted to provide for greater compliance to prevent vibration of the roller against the surface. The thermoplastic material includes olefin having a resistivity greater than approximately 50,000 ohms so that current leaks to a defective surface many be prevented.

BRIEF DESCRIPTION OF THE DRAWINGS

The invention will be described in detail herein with reference to the following figures in which like reference numerals denote like elements and wherein.

DETAILED DESCRIPTION OF PREFERRED EMBODIMENTS

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 4:
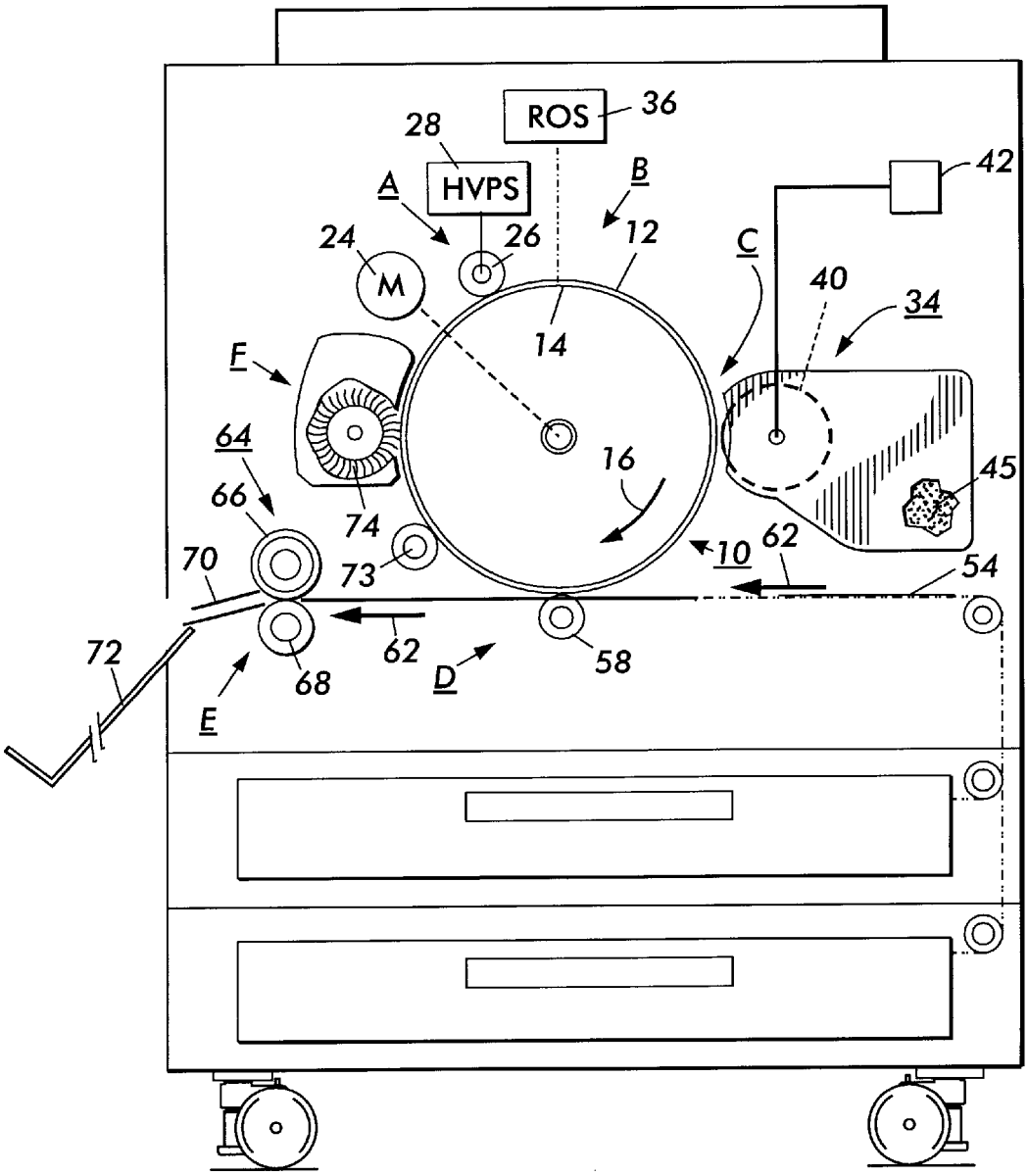
FIG. 4 is a schematic elevational view of an illustrative electrophotographic printing machine incorporating the vibration absorbing bias charge roll of the present invention therein.

For a general understanding of the illustrative electrophotographic printing machine incorporating the features of the present invention therein, reference is made to the drawings. In the drawings, like reference numerals have been used throughout to designate identical elements. FIG. 4 schematically depicts the various components of an electrophotographic printing machine incorporating the vibration absorbing bias charge roll of the present invention therein. Although the vibration absorbing bias charge roll of the present invention is particularly well adapted for use in the illustrative printing machine, it will become evident that the vibration absorbing bias charge roll is equally well suited for use in a wide variety of printing machines and are not necessarily limited in its application to the particular embodiment shown herein.

Referring now to FIG. 4, the electrophotographic printing machine shown employs a photoconductive drum, although photoreceptors in the form of a belt are also known, and may be substituted therefor. The drum has a photoconductive surface deposited on a conductive substrate 14. The drum moves in the direction of arrow 16 to advance successive portions thereof sequentially through the various processing stations disposed about the path of movement thereof. Motor 24 rotates roll 22 to advance drum in the direction of arrow 16. Drum is coupled to motor 24 by suitable means such as a drive.

Initially successive portions of drum pass through charging station A. At charging station A, a corona generating device, in the form of a bias charge roll which is indicated generally by the reference numeral 26, charges the drum 10 to a selectively high uniform electrical potential, preferably negative. Any suitable control, well known in the art including for example HVPS 28, may be employed for controlling the corona generating device 26.

In a digital printing machine as shown in FIG. 4, the drum 100 passes through imaging station B where a ROS (Raster Optical Scanner) 36 may lay out the image in a series of horizontal scan lines with each line having a specific number of pixels per inch. The ROS 36 may include a laser (not shown) having a rotating polygon mirror block associated therewith. The ROS 36 exposes the photoconductive surface 12 of the belt.

It should be appreciated that the printing machine may alternatively be a light lens copier. In a light lens copier a document to be reproduced is placed on a platen, located at the imaging station, where it is illuminated in known manner by a light source such as a tungsten halogen lamp. The document thus exposed is imaged onto the drum by a system of mirrors. The optical image selectively discharges the surface of the drum in an image configuration whereby an electrostatic latent image of the original document is recorded on the drum at the imaging station.

At development station C, a development system or unit, indicated generally by the reference numeral 34 advances developer materials into contact with the electrostatic latent images. Preferably, the developer unit includes a developer roller mounted in a housing. Thus, developer unit 34 contains a developer roller 40. The roller 40 advances toner particles 45 into contact with the latent image. Appropriate developer biasing may be accomplished via power supply 42, electrically connected to developer unit 34.

The developer unit 34 develops the charged image areas of the photoconductive surface. This developer unit contains magnetic black toner particles 45, for example, which are charged by the electrostatic field existing between the photoconductive surface and the electrically biased developer roll in the developer unit. Power supply 42 electrically biases the magnetic roll 40.

A sheet of support material 54 is moved into contact with the toner image at transfer station D. The sheet of support material is advanced to transfer station D by a suitable sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of drum 10 in a timed sequence so that the toner powder image developed thereon contacts the advancing sheet of support material at transfer station D.

Transfer station D includes a corona generating device 58 in the form of a bias charge roll, which applies ions of a suitable polarity onto the backside of sheet 54. This attracts the toner powder image from the drum 10 to sheet 54. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 54. Preferably, fuser assembly 64 comprises a heated fuser roller 66 and a pressure roller 68. Sheet 54 passes between fuser roller 66 and pressure roller 68 with the toner powder image contacting fuser roller 66. In this manner, the toner powder image is permanently affixed to sheet 54. After fusing, a chute 70 guides the advancing sheet 54 to a catch tray 72 for subsequent removal from the printing machine by the operator. It will also be understood that other post-fusing operations can be included, for example, stapling, binding, inverting and returning the sheet for duplexing and the like.

After the sheet of support material is separated from the photoconductive surface of drum 10, the residual toner particles carried by image and the non-image areas on the photoconductive surface removed at cleaning station F. The vacuum assisted, electrostatic, brush cleaner unit or cleaning blade is disposed at the cleaning station F to remove any residual toner remaining on the surface of the drum.

It is believed that the foregoing description is sufficient for purposes of the present application to illustrate the general operation of an electrophotographic printing machine incorporating the development apparatus of the present invention therein.

Figure 1:
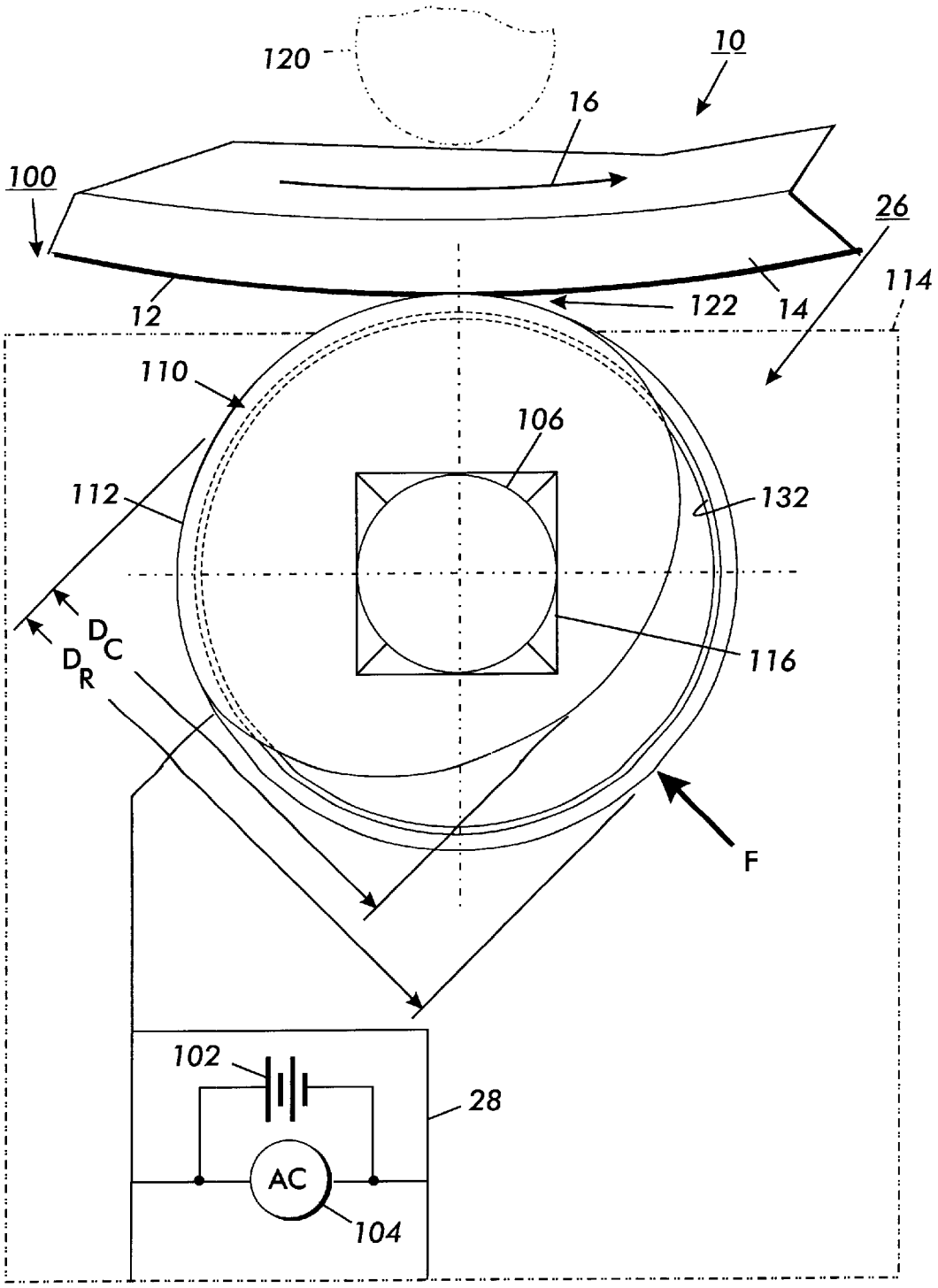
FIG. 1 is a perspective view of an embodiment of the vibration absorbing bias charge roll of the present invention.

According to the present invention and referring now to FIG. 1, charging device 100 is shown incorporating the charging roller 26 of the present invention therein. The charging device 100 as shown in FIG. 1 includes the charging roller 26 which is electrically connected to high voltage power supply 28. The high voltage power supply 28 may be any conventional power source and typically will include a D.C. voltage, superimposed with an A.C voltage which is no less than twice the level of the DC voltage.

The charging roller 26 includes a shaft 106. The shaft 106 may be made of any suitable, durable material and may for example be made of a metal. Preferably, the shaft 106 is preferably electrically conductive. The shaft 106 is thus preferably made from an electrically conductive metal, for example, steel.

The charging roller 26 further includes a semi-conductive foam material 110 which surrounds at least a portion of the shaft 106. The charging roller 26 further includes a thermoplastic seamless sleeve 112 which surrounds at least a portion of the foam material 110. The foam material 110 is adapted to provide for greater compliance with the photoconductive belt 10 to prevent vibration of the roller 26 against the surface 12 of the photoconductive drum 10. It should be appreciated that the charging roller 26 of the present invention may be equally well suited for use in printing machines utilizing photoconductive belts rather than photoconductive drums as shown in the figures.

The foam material 110 may be any material selected to provide for the sufficient compliance for preventing the vibration of the roller 26. For example, as shown in FIG. 1, the foam material 110 may be made of a material such that the charging roll 26 when compressed by a force F of for example 10 pounds may be conformed from a round cross-section having a diameter $D_R$ of say, for example, 12 millimeters, to an elliptical shape with a dimension $D_C$ in the direction of the force F of, for example, 9.6 millimeters. For example, as shown in FIG. 1, the foam material 110 may be selected such that the ratio $D_c$ over $D_r$ is less than or equal to 0.80. Thus a force of F of 10 pounds would result in at least a 20% compression of the roll. Such compression of the roll assures continual contact between the photoconductive surface 12 and the charging roller 26 even in the presence of severe vibration within the printing machine.

The charging roller 26 may be mounted in the printing machine in any suitable fashion. For example, as shown in FIG. 1, the charging roll 26 may be mounted to housing 114 of the printing machine by supports 116 secured to the shaft 106. The housing 114 may simply be part of the frame of the printing machine or may be a separate housing to provide for a, for example, charging module (not shown) whereby the charge roller 26 may be simply and easily removed from the printing machine. The supports 116 may be any suitable support for rotatably supporting the charging roll 26. For example, the supports 116 may be a sleeve bearing made of suitable material for rotatably supporting the shaft 106.

Figure 2:
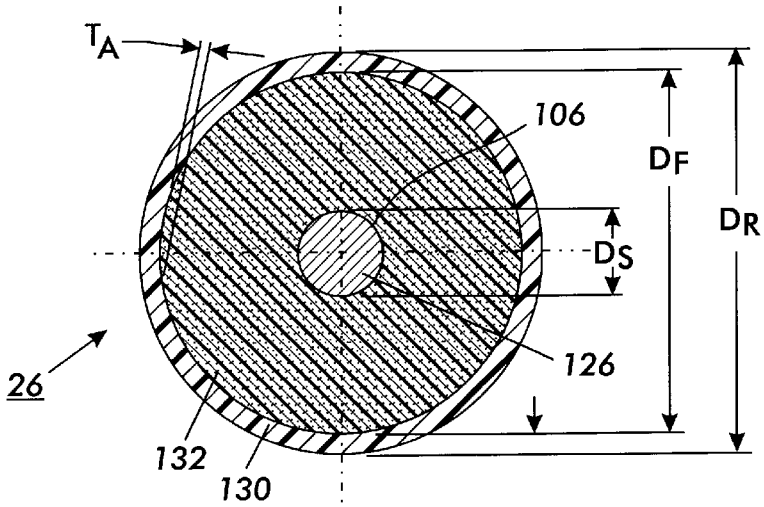
FIG. 2 is a cross sectional view along the line 3—3 in the direction of the arrows of the FIG. 1 vibration absorbing bias charge roll.
Figure 3:
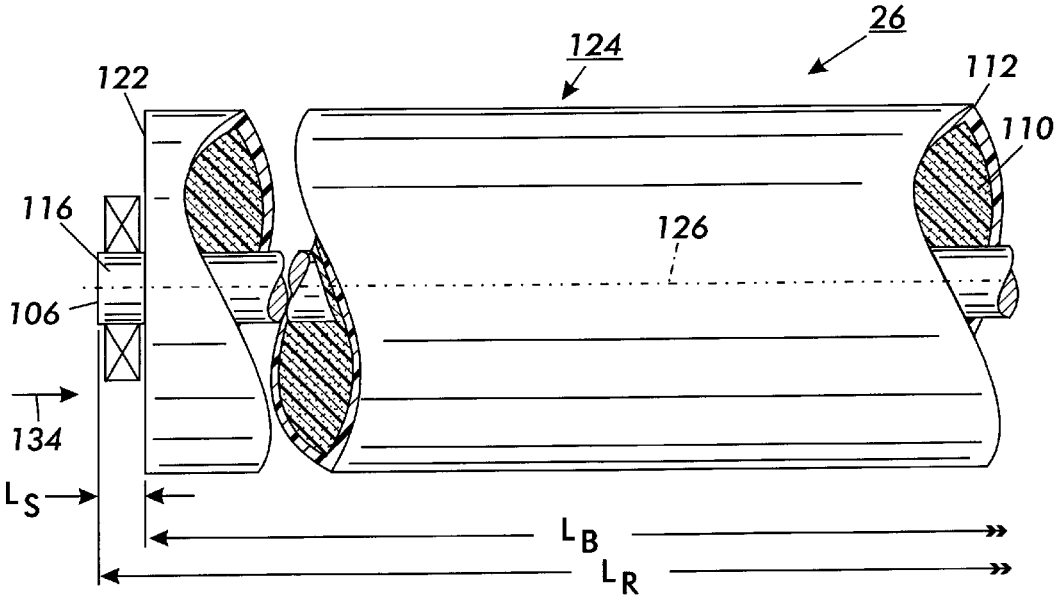
FIG. 3 is a plan view of the vibration absorbing bias charge roll of FIG. 2.

Referring now to FIGS. 2 and 3, the charging roller 26 is shown in greater detail. The charging roller 26 may have any size capable of transferring the required charge to the photoconductive surface of the photoconductive member. Preferably, the charging roller 26 has a length sufficient to apply the charge to the entire width of the photoconductive drum or belt. For printing machines for printing cut sheets, the photoconductive belt or drum has a width of, for example, 9 inches or 11½ inches or 18 inches to correspond to sheets having a width of, for example, 8½ inches, 11 inches or 17 inches, respectively.

For photoconductive surfaces having a width of, for example, 12 inches, the charging roller 12 will similarly have a charge roller length $L_B$ of slightly larger than 12 inches. The charge roller 26 may have any diameter capable of providing a roller with sufficient ability to conform against the photoconductive surface to maintain contact during vibration. Applicants have found that a roller with a diameter $D_R$ of, for example, 12 to 14 millimeters, is sufficiently large to provide for ample conformability.

For a charging roller 26 with a diameter $D_R$ of 12 millimeters, the diameter $D_S$ of the shaft 106 may be, for example, 6 millimeters. The shaft 106 extends outwardly from ends 122 of the body 124 of the charge roller 26, a distance $L_S$ of, for example, 10 millimeters. The portion of the shaft 106 which extends past the ends 122 is utilized to cooperate with supports 116 for supporting the charge roller 26. The shaft thus has a length $L_R$ which is approximately 20 millimeters larger than $L_B$ of the body 124. Thus for a charge roller 26 having a body diameter $L_B$ of 250 millimeters, the length $L_R$ of the charge roller 26 is approximately 270 millimeters. The charge roller 26 rotates about axis 126 being rotatable about supports 116.

The foam material 110 extends outwardly from the shaft 106 within the body 124. The foam 110 has a diameter $D_F$ which is slightly smaller than the diameter $D_R$ of the roller. For a roller $D_R$ of approximately 12 millimeters, the diameter $D_F$ of the foam is approximately 11.5 millimeters. The foam material 110 is selected such that the foam is compressible by a ratio $D_C$ over $D_F$ of less than or equal to 0.80 when a 10 pound force is applied to the outer periphery of the charge roll 26 as explained above.

The applicants have found that a semi-conductive cellular foam is capable of obtaining the compressibility described above. To obtain the compressibility above, the foam material 110 preferably has a hardness of 40 AskerC or less. A material capable of obtaining the required compressibility for the foam 110 is carbon loaded urethane foam manufactured by Rogers Corporation.

The thermoplastic sleeve material 112 is secured to the outer periphery 130 of the foam material 110 in any suitable fashion. For example, the thermoplastic material 112 might be secured to the foam 110 through the use of a conductive adhesive 132 applied to the periphery 130 of the foam 110. The adhesive 132 may be any conductive adhesive capable of securing the thermoplastic sleeve material 112 to the foam 110 and not being negatively chemically reactive therewith. The applicants have found that by making the inner diameter of the thermoplastic sleeve material slightly smaller that the foam diameter $D_F$, the interference sufficiently holds the sleeve in place over the semi-conductive foam.

The foam 110 may be secured to the shaft 106 in any suitable fashion such as with conductive adhesive. For example, if the foam 110 is molded to the shaft 106, the foam 110 will adhere thereto. The foam material 110 is preferably selected to have a resistivity capable of providing the proper charging for the charge roller 26. The applicants have found that a carbon loaded urethane foam material 110 with a resistivity of around 100 to 1000 ohms is particularly effective for the charge roller 26 of the present invention.

The thermoplastic sleeve material 112 may be any material capable of providing sufficient support for the foam 110. Preferably, the thermoplastic material 112 is in the form of conductive olefin. Certain olefins have been found to be particularly effective. Among these olefins are polyethylene and polypropylene. Polyethylene, in particular, has found to be suitable for this application.

The thermoplastic sleeve material 112 may be applied to the charge roller 26 in any suitable fashion. Preferably, for example, the thermoplastic material 112 may be in the form of a sleeve having an outer diameter of, for example $D_R$ of 12 millimeters and an inner diameter slightly smaller than the diameter $D_F$ of the foam. The sleeve thus has a thickness $T_s$ (not shown) of, for example, about 0.25 millimeters. The thermoplastic sleeve 112 is inserted in the direction of arrow 134 on to the foam 110.

The conductive adhesive 132 may be utilized to secure the thermoplastic sleeve 112 to the foam material 110 if required.

The use of olefins for the thermoplastic sleeves 112 are particularly well suited for this application for at least two separate reasons. The first of these reasons is that the conducting olefins are materials that are minimally affected by temperature and humidity. The printing machines may be subject to temperatures ranging from 70° Fahrenheit to 80° Fahrenheit and relative humidities of 10% to 80%. Such environmental changes particularly with humidity may greatly affect electrical properties of materials heretofore used for charging rollers. Olefins, such as polyethylene and polypropylene on the other hand, are minimally affected by the temperature and humidity.

Further, the use of olefins may provide for an outer sleeve with the proper resistivity. Olefins can be made semi-conductive, to create a sleeve with a resistance of approximately 100,000 ohms. The use of a charging roller 26 with a foam material 110 of around 100 to 1000 ohms and a thermoplastic sleeve 112 with a resistance of approximately 100,000 ohms provides for a charging roller with a low conductivity on the surface of the roll.

The use of a charging roll 26 with a low conductivity on the outer periphery of the charging roll makes the use of the charging roll less susceptible to defects in the photoconductor. The defects in a photoconductor can cause current leaks to a more conductive charging roller. The use of the high resistance, 100,000 ohms, on the thermal plastic sleeve 112 reduces the effects of defects in a photoconductive surface on the charging roller.

By providing a charge roll with a foam core made of a material having a hardness of 40 AskerC or less, a more compliant roll may be provided which assures contact between the charging roll and the photoconductive and dampens the vibration to reduce the amount of audible noise generated by the vibration in the charge roll and photoreceptor drum interface.

By providing a charging roll with a foam core made of carbon loaded urethane material, a more compliant roll can be provided compared to a solid rubber core, which assures contact between the photoconductive surface and the charging roll. This added compliance reduces the level of audible noise generated by the vibration in the charge roll and photoreceptor drum interface.

By providing a charging roll with a thermoplastic sleeve having a resistance around 100,000 ohms, current leaks caused from defects in the photoconductive roll can be minimized.

By providing a charging roll with an outer sleeve having a resistance of around 100,000 ohms and a foam core having a resistance of around 100 to 1000 ohms, a charging roll can be provided which is more tolerant to current leaks caused by defects in the photoconductive surface.

By providing for a charging roller made from a thermoplastic olefin material, a charging roll may be provided which is less susceptible to environmental changes due to temperature and humidity.

By providing a charging roller made with a sleeve of polyethylene or polypropylene, a charging roll may be provided which is less susceptible to environmental changes of humidity and temperature.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

We claim:

1. A charging roller for use in a machine in which an electrical bias is applied to a surface of a member, said charging roller comprising:

a shaft;

a foam material surrounding at least a portion of said shaft;

a thermoplastic material surrounding at least a portion of said foam material, the foam material providing greater compliance to prevent vibration of the roller against the surface;

wherein said shaft, said foam material and said thermoplastic material is selected so that a radial force of 10 pounds applied to a periphery of the roller would result in at least a 20% radial compression of the roller.

2. A charging roller according to claim 1, further comprising an adhesive applied to at least a portion of a periphery of said foam material; said thermoplastic material surrounding at least a portion of said adhesive.

3. A charging roller according to claim 1 wherein said thermoplastic material comprises a sleeve interferencely fitted over said foam material.

4. A charging roller according to claim 2, wherein said thermoplastic material comprises a seamless sleeve.

5. A charging roller according to claim 1, wherein said thermoplastic material comprises thermoplastic olefin.

6. A charging roller according to claim 1, wherein said thermoplastic material comprises olefin having a resistivity greater than approximately 50,000 ohms so that current leaks to a defective surface may be minimized.

7. A charging roller according to claim 1, wherein said thermoplastic material comprises at least one of polyethylene and polypropylene.

8. A charging roller according to claim 1, wherein said foam material has a hardness of less than or equal to 40 AskerC.

9. A charging roller according to claim 1, wherein said foam material comprises a conductive cellular foam having a resistance of approximately 100 to 1000 ohms.

10. A charging roller according to claim 1, wherein said foam material comprises carbon loaded urethane foam.

11. An electrophotographic printing machine in which an electrical bias is applied to a surface of a member, the electrophotographic printing machine comprising:

a housing defining a chamber therein; and a charging roller mounted to said housing and positioned at least partially therein, said charging roller including a shaft, a foam material surrounding at least a portion of said shaft, and a thermoplastic material surrounding at least a portion of said foam material, said foam material providing greater compliance to prevent vibration of the roller against the surface;

wherein said foam material and said thermoplastic material is selected so that a radial force of 10 pounds applied to a periphery of the roller would result in at least a 20% radial compression of the roller.

12. A printing machine according to claim 11, further comprising an adhesive applied to at least a portion of a periphery of said foam material; said thermoplastic material surrounding at least a portion of said adhesive.

13. A printing machine according to claim 11 wherein said thermoplastic material comprises a sleeve interferencely fitted over said foam material.

14. A printing machine according to claim 11, wherein said thermoplastic material comprises a seamless sleeve.

15. A printing machine according to claim 11 wherein said thermoplastic material comprises olefin having a resistivity greater than approximately 50,000 ohms so that current leaks to a defective surface may be minimized.

16. A printing machine according to claim 11, wherein said thermoplastic material comprises at least one of polyethylene and polypropylene.

17. A printing machine according to claim 11, wherein said foam material has a hardness of less than or equal to 40 AskerC.

18. A printing machine according to claim 11, wherein said foam material comprises a semi-conductive urethane foam having a resistance of approximately 100 to 1000 ohms.

19. A printing machine according to claim 11, wherein said foam material comprises carbon loaded urethane foam.

20. A printing machine according to claim 11, wherein said thermoplastic material comprises olefin.

21. A charging roller for use in a machine in which an electrical bias is applied to a surface of a member, said charging roller comprising:

a steel shaft;

a conductive cellular foam material surrounding at least a portion of said shaft, said foam material having hardness of less than or equal to 40 AskerC and a resistance of approximately 100 to 1000 ohms;

an adhesive applied to at least a portion of a periphery of said foam material; and a thermoplastic material seamless sleeve surrounding at least a portion of said adhesive, said foam material providing greater compliance to prevent vibration of the roller against the surface, said thermoplastic material including olefin having a resistivity greater than approximately 50,000 ohms so that current leaks to a defective surface may be prevented.

22. A charging roller for use in a machine in which an electrical bias is applied to a surface of a member, said charging roller comprising:

a shaft;

a foam material surrounding at least a portion of said shaft; and a thermoplastic material surrounding at least a portion of said foam material, the foam material providing greater compliance to prevent vibration of the roller against the surface;

wherein said thermoplastic material comprises olefin having a resistivity greater than approximately 50,000 ohms so that current leaks to a defective surface may be minimized.

23. A charging roller for use in a machine in which an electrical bias is applied to a surface of a member, said charging roller comprising:

a shaft;

a foam material surrounding at least a portion of said shaft; and a thermoplastic material surrounding at least a portion of said foam material, the foam material providing greater compliance to prevent vibration of the roller against the surface;

wherein said foam material has a hardness of less than or equal to 40 AskerC.

24. A charging roller for use in a machine in which an electrical bias is applied to a surface of a member, said charging roller comprising:

a shaft;

a foam material surrounding at least a portion of said shaft; and a thermoplastic material surrounding at least a portion of said foam material, the foam material providing greater compliance to prevent vibration of the roller against the surface;

wherein said foam material comprises a conductive cellular foam having a resistance of approximately 100 to 1000 ohms.

25. An electrophotographic printing machine in which an electrical bias is applied to a surface of a member, the electrophotographic printing machine comprising:

a housing defining a chamber therein; and a charging roller mounted to said housing and positioned at least partially therein, said charging roller including a shaft, a foam material surrounding at least a portion of said shaft, and a thermoplastic material surrounding at least a portion of said foam material, said foam material providing greater compliance to prevent vibration of the roller against the surface;

wherein said thermoplastic material comprises olefin having a resistivity greater than approximately 50,000 ohms so that current leaks to a defective surface may be minimized.

26. An electrophotographic printing machine in which an electrical bias is applied to a surface of a member, the electrophotographic printing machine comprising:

a housing defining a chamber therein; and a charging roller mounted to said housing and positioned at least partially therein, said charging roller including a shaft, a foam material surrounding at least a portion of said shaft, and a thermoplastic material surrounding at least a portion of said foam material, said foam material providing greater compliance to prevent vibration of the roller against the surface;

wherein said foam material has a hardness of less than or equal to 40 AskerC.

27. An electrophotographic printing machine in which an electrical bias is applied to a surface of a member, the electrophotographic printing machine comprising:

a housing defining a chamber therein; and a charging roller mounted to said housing and positioned at least partially therein, said charging roller including a shaft, a foam material surrounding at least a portion of said shaft, and a thermoplastic material surrounding at least a portion of said foam material, said foam material providing greater compliance to prevent vibration of the roller against the surface;

wherein said foam material comprises a semiconductor urethane foam having a resistance of approximately 100 to 1000 ohms.

28. A charging roller for use in a machine in which an electrical bias is applied to a surface of a member, said charging roller comprising:

a shaft;

a foam material surrounding at least a portion of said shaft; and a thermoplastic material surrounding at least a portion of said foam material, the foam material filling a cavity between the shaft and the thermoplastic material and providing greater compliance to prevent vibration of the roller against the surface.

* * * * *